United States Patent [19]

Wilsberg

[11] 4,288,339

[45] Sep. 8, 1981

[54] SPRAY CLEANER COMPOSITION FOR THE SPOT TREATMENT OF TEXTILES BEFORE WASHING

[75] Inventor: Heinz-Manfred Wilsberg, Monheim-Baumberg, Fed. Rep. of Germany

[73] Assignee: Henkel Kommanditgesellschaft auf Aktien, Dusseldorf-Holthausen, Fed. Rep. of Germany

[21] Appl. No.: 187,521

[22] Filed: Sep. 15, 1980

[30] Foreign Application Priority Data

Oct. 1, 1979 [DE] Fed. Rep. of Germany ..... 2939810

[51] Int. Cl.[3] ..... C11D 1/68; C11D 1/825; C11D 3/44; C11D 17/08

[52] U.S. Cl. ..... 252/90; 8/137; 8/139.1; 252/162; 252/170; 252/171; 252/174.11; 252/174.21; 252/174.22; 252/305; 252/DIG. 1

[58] Field of Search ..... 252/90, 118, 122, 153, 252/162, 170, 171, 174.21, 174.22, DIG. 1, DIG. 14, 305; 8/137, 139.1

[56] References Cited

U.S. PATENT DOCUMENTS

| | | | |
|---|---|---|---|
| 3,625,909 | 12/1971 | Berg | 252/153 |
| 3,707,506 | 12/1972 | Lozo | 252/139 |
| 3,741,902 | 6/1973 | Barrett | 252/90 |
| 3,870,647 | 3/1975 | Travers | 252/118 |
| 3,931,033 | 1/1976 | Löhr | 252/122 |
| 3,994,818 | 11/1976 | Loo | 252/171 |
| 4,093,417 | 6/1978 | Heinlein | 8/137 |
| 4,153,570 | 5/1979 | Hennemann | 252/121 |
| 4,161,458 | 7/1979 | Kolleth | 252/305 |
| 4,178,262 | 12/1979 | Compton | 252/162 |
| 4,199,482 | 4/1980 | Renaud | 252/559 |
| 4,201,686 | 5/1980 | Augustijin | 252/174.22 |

*Primary Examiner*—Dennis L. Albrecht
*Attorney, Agent, or Firm*—Hammond & Littel, Weissenberger and Muserlian

[57] ABSTRACT

A spray cleaner composition for use with a propellant that is gaseous at room temperature, for the spot treatment of textiles before washing, consisting essentially of, without propellant, (a) from 6% to 16% by weight of ethoxylated $C_6$–$C_{10}$-alcohols selected from the group consisting of alkanols and alkenols, having an average of from 4 to 8 ethylene glycol ether groups, wherein the content of saturated $C_8$-alkanol is at least 50% by weight, (b) from 6% to 10% by weight ethoxylated $C_{12}$–$C_{18}$-alcohols selected from the group consisting of alkanols and alkenols, having an average of from 2 to 4 ethylene glycol ether groups, wherein the content of $C_{16}$–$C_{18}$-alkanols is not more than 50% by weight, (c) from 6% to 10% by weight of ethoxylated of $C_{16}$–$C_{18}$-alcohols selected from the group consisting of alkanols and alkenols, having an average of from 10 to 15 ethylene glycol ether groups, (d) from 20% to 50% by weight of aliphatic hydrocarbons having a boiling range of from 180° to 260° C., and (e) from 10% to 35% by weight of at least one chlorohydrocarbon selected from the group consisting of methylene chloride, ethylene chloride, 1,1,1-trichloroethane and perchloroethane;

with the proviso that components (a), (b) and (c) amount to from 20% to 35% by weight of said composition and components (d) and (e) amount to from 65% to 80% by weight of said composition.

7 Claims, No Drawings

SPRAY CLEANER COMPOSITION FOR THE SPOT TREATMENT OF TEXTILES BEFORE WASHING

BACKGROUND OF THE INVENTION

The subject of the present invention is a cleaning agent that can be used to treat heavily soiled parts of a wash, such as collar and cuffs, which is then washed in the usual way. Such agents potentiate the effect of the wash detergent on stubborn stains that usually are not adequately removed by the wash detergent in a wash cycle for "delicate fabrics" at 30° to 40° C. or for "wash and wear" at 50° to 60° C. Such respective pretreatment agents are known in the form of paste-like or liquid concentrates, or as viscous masses in the form of applicator sticks, as well as in the form of sprays. It was found that the consumer especially prefers substances that can be sprayed, as they are convenient and can be evenly applied over the soiled parts without the use of a finger or spatula on the one hand, and, on the other, they penetrate also into the deeper fibers of coarsely loomed textiles and consequently are superior to a superficially applied material with respect to cleaning power.

Certain demands are made on such spray cleaners, which are not met in their entirely by the substances known so far. These are:

1. High dissolving power working on fats, oils and waxes;
2. Prevention of a halo formation due to the edge of the soil spreading through the textiles;
3. Complete removal during the subsequent washing, the tenside components employed in the spray cleaner should not leave any fat-like stain on the textile after washing;
4. Prevention of increased foaming during the subsequent washing process;
5. Non-flammability;
6. No toxic effect on humans and animals;
7. Adequate biodegradability of the detergent raw materials used in the waste water;
8. The composition should be combined in such proportions that the use of fluorinated hydrocarbons as propellant is not required.

OBJECTS OF THE INVENTION

A object of the present invention is the development of a spray cleaner composition for the spot treatment of textiles, before washing which will fullfil all the above requirements.

Another object of the present invention is the development of a spray cleaner composition for use with a propellant that is gaseous at room temperature, for the spot treatment of textiles before washing, consisting essentially of, without propellant, (a) from 6% to 16% by weight of ethoxylated $C_6$–$C_{10}$-alcohols selected from the group consisting of alkanols and alkenols, having an average of from 4 to 8 ethylene glycol ether groups, wherein the content of saturated $C_8$-alkanol is at least 50% by weight, (b) from 6% to 10% by weight of ethoxylated $C_{12}$–$C_{18}$-alcohols selected from the group consisting of alkanols and alkenols, having an average of from 2 to 4 ethylene glycol ether groups, wherein the content of $C_{16}$–$C_{18}$-alkanols is not more than 50% by weight, (c) from 6% to 10% by weight of ethoxylated $C_{16}$–$C_{18}$-alcohols selected from the group consisting of alkanols and alkenols, having an average of from 10 to 15 ethylene glycol ether groups, (d) from 20% to 50% by weight of aliphatic hydrocarbons having a boiling range of from 180° to 260° C., and (e) from 10% to 35% by weight of at least one chlorohydrocarbon selected from the group consisting of methylene chloride, ethylene chloride, 1,1,1-trichloroethane and perchloroethane;

with the proviso that components (a), (b) and (c) amount to from 20% to 35% by weight of said composition and components (d) and (e) amount to from 65% to 80% by weight of said composition.

These and other objects of the invention will become more apparent as the description thereof proceeds.

DESCRIPTION OF THE INVENTION

We have now discovered a spray cleaner composition which meets the above requirements. The spray cleaner compositions of the invention is suitable for the treatment of textiles and contains a propellant that is gaseous at room temperature and is characterized by the fact that the components without the propellant have the following composition:

(a) from 6% to 16% by weight of $C_6$–$C_{10}$-alcohols ethoxylated with an average of 4 to 8 ethylene glycol ether groups, and a content of at least 50% by weight of saturated $C_8$-alcohol;

(b) from 6% to 10% by weight of $C_{12}$–$C_{18}$-alcohols ethoxylated with an average of 2 to 4 ethylene glycol ether groups, and a content of not more than 50% by weight of saturated $C_{16}$–$C_{18}$-alcohols;

(c) from 6% to 10% by weight of $C_{16}$–$C_{18}$-alcohols ethoxylated with an average of 10 to 15 ethylene glycol ether groups;

(d) from 20% to 50% by weight of aliphatic hydrocarbons with a boiling range from 180° to 260° C.

(e) from 10% to 35% by weight of at least one chlorohydrocarbon from the series; methylene chloride, ethylene chloride, 1,1,1-trichloroethane and perchloroethylene; wherein the content of the components given under (a) to (c) amount to 20% to 35% by weight, and that of the solvents (d) and (e) amount to 65% to 80% by weight of the spray cleaner composition.

More particularly, the present invention relates to a spray cleaner composition for use with a propellant that is gaseous at room temperature, for the spot treatment of textiles before washing, consisting essentially of, without propellant, (a) from 6% to 16% by weight of ethoxylated $C_6$–$C_{10}$-alcohols selected from the group consisting of alkanols and alkenols, having an average of from 4 to 8 ethylene glycol ether groups, wherein the content of saturated $C_8$-alkanol is at least 50% by weight, (b) from 6% to 10% by weight of ethoxylated $C_{12}$–$C_{18}$-alcohols selected from the group consisting of alkanols and alkenols, having an average of from 2 to 4 ethylene glycol ether groups, wherein the content of $C_{16}$–$C_{18}$-alkanols is not more than 50% by weight, (c) from 6% to 10% by weight of ethoxylated $C_{16}$–$C_{18}$-alcohols selected from the group consisting of alkanols and alkenols, having an average of from 10 to 15 ethylene glycol ether groups, (d) from 20% to 50% by weight of aliphatic hydrocarbons having a boiling range of from 180° to 260° C., and (e) from 10% to 35% by weight of at least one chlorohydrocarbon selected from the group consisting of methylene chloride, ethylene chloride, 1,1,1-trichloroethane and perchloroethane;

with the proviso that components (a), (b) and (c) amount to from 20% to 35% by weight of said composition and components (d) and (e) amount to from 65% to 80% by weight of said composition.

The alcohols on which the nonionic tenside components under (a) to (c) are based may have a straight chain or methyl branches in position 2, may be saturated or olefinically mono-unsaturated. They may be of natural or synthetic origin, for example, obtained by ethylene polymerization or oxo-synthesis, or be present as mixtures of such alcohols. Specifically they are $C_6$-$C_{18}$-alcohols selected from the group consisting of alkanols and alkenols.

The component listed under (a) preferably contains at least 75% by weight of saturated possibly isomeric octanols ethoxylated with an average of 5 to 7 ethylene glycol ether groups.

The component listed under (b) preferably consists of a mixture of two nonionic compounds ($b_1$) and ($b_2$) at a ratio of 1:4 to 4:1 by weight. Component ($b_1$) preferably consists of saturated $C_{12}$-$C_{14}$-alkanols ethoxylated with an average of 2 to 4 ethylene glycol ether groups. Component ($b_2$) preferably consists of saturated or mono-unsaturated $C_{16}$-$C_{18}$-alcohols ($C_{16}$-$C_{18}$-alkanols and $C_{16}$-$C_{18}$-alkenols) ethoxylated with an average of 2 to 3 ethylene glycol ether groups, the proportion of whose saturated $C_{16}$-$C_{18}$-alkanols does not amount to more than 65% by weight, and especially not more than 50% by weight. Suitable as mono-unsaturated alcohol is for example, oleyl alcohol.

The component listed under (c) preferably has an average of 11 to 13 ethylene glycol ether groups and derives from olefinically mono-unsaturated or saturated $C_{16}$-$C_{18}$-alcohols ($C_{16}$-$C_{18}$-alkanols and $C_{16}$-$C_{18}$-alkenols) or their mixtures. When alcohol mixtures are used as starting material, these may be 50 to 100% saturated and consist, for example, of mixtures of cetyl, stearyl and, optionally oleyl alcohol, such as can be obtained from tallow fatty alcohols, for example.

It was found that the component (b) and, to a somewhat greater degree, the mixture of ($b_1$) and ($b_2$) are responsible for the good release of fatty or waxy stains by washing. However, as lower ethoxylated compounds, they emulsify relatively poorly in moderately warm detergent solutions and may leave behind fatty spots and rings on textiles because of their incomplete removal by washing. This disadvantage is completely counteracted, however, by the additional use of the components listed under (a) and (c), and with these, the soil-loosening properties of th substances are intensified still furhter.

Component (d) consists of a high-boiling benzine fraction that preferably has a boiling range of from 205° to 245° C., and is present especially in an amount of 35% to 45% by weight, based on the mixture without propellant. The amount of hydrocarbon is calculated so that the substance is non-flammable when acting together with the remaining components and thus can be handled safely in the household.

The lower molecular weight chlorinated hydrocarbons according to component (e), which also may be present in the form of a mixture, preferably are in an amount from 20% to 32% by weight, based on the components without the propellant. The preferred chlorinated hydrocarbon is methylenechloride. The amount of the chlorohydrocarbons is limited so that no damage to the health of humans and pets is to be expected through their application, even upon inadvertent inhalation.

The choice and the amount of solvents (d) and (e) guarantees that even waxy contaminations, for example, such due to candle wax, are sufficiently preloosened so that they can be washed out during the subsequent washing. Besides, the solvents do not cause the formation of rings in the chosen composition.

In addition to the listed components, the substances also may contain perfumes, particularly those that hide the inherent odor of the solvents and of the surfactant components. Amounts from 0.1% to 1% by weight of the composition without propellant of perfume oil generally are adequate for this purpose.

Suitable as propellants are gases and low-boiling solvents that are gaseous at room temperature, which are generally used for the preparation of aerosols. The special advantage of the substances according to the invention is the fact that they do not require the use of propellants such as hydrocarbons that increase the flammability, such as propane or butane, or propellants containing fluoride, which are considered undesirable for environmental reasons. Carbon dioxide is preferably used as propellant, with 2 to 3 parts by weight of carbon dioxide being employed for 98 to 97 parts by weight of the components of the spray cleaner without propellant. Higher proportions of carbon dioxide, for example, up to a ratio of 3.6 parts by weight of carbon dioxide per 96.4 parts by weight of components without propellant, are possible, but such mixtures necessitate the use of more expensive spray cans with a pressure resistance of more than 15 kp/cm$^2$, whereas a pressure resistance of 10 to 15 kp/cm$^2$ is adequate when the ratios given above are not exceeded.

The following examples are illustrative of the invention without being limitative thereto.

EXAMPLES

In the following examples "EO" represents ethylene oxide, the number preceding "EO" represents the average moles of ethylene oxide adducted onto the alcohol. The percentages given are percent by weight.

EXAMPLE 1

A spray cleaner composition of the following formulation was prepared by mixing the ingredients.

(a) 8.0% n-octanol + 6 EO ($C_6$- and $C_{10}$- portion 1% each)

($b_1$) 4.0% oleyl/stearyl alcohol (1:1) + 2 EO ($b_2$) 4.0% lauryl/myristyl alcohol (1:1) + 3 EO (c) 8.0% cetyl/stearyl alcohol (1:1) + 12 EO (d) 45% benzine (BP 205°-245° C.)

(e)

30.8% methylene chloride 0.2% perfume.

97.6 Parts by weight of this mixture and 2.4 parts by weight of carbon dioxide were filled into aerosol cans. Fat and wax spots on wash and wear textiles that were sprayed with the substance and then washed with a commercial detergent at 60° C. in a drum washing machine were completely removed. The foaming characteristics during washing remained unaffected. No soil rings or spots due to remaining tenside residues were found on the washed textiles.

EXAMPLE 2

A spray cleaner composition of the following formulation was prepared by mixing the ingredients.

(a) 7.5% n-octanol + 6.5 EO ($C_6$- and $C_{10}$- portion 1% each)

(b) 8.5% oleyl/cetyl/stearyl alcohol (1:0.3:0.6) + 2 EO (c) 9.5% oleyl/cetyl/stearyl alcohol (1:0.3:0.6) + 11.5 EO (d) 45.0% benzine (BP 205°-245° C.)

(e)
29.3% methylene chloride
0.2% perfume oil.

97.5 Parts by weight of this mixture and 2.5 parts by weight of carbon dioxide were filled into aerosol cans. The cleaner composition had the same properties as that according to Example 1.

EXAMPLE 3

The following spray cleaner composition was formulated by mixing the ingredients.

(a) 16.0% n-octanol + 6 EO ($C_6$- and $C_{10}$-portions 1% each)

($b_1$) 4.0% oleyl/stearyl alcohol (1:1) + 2 EO ($b_2$) 4.0% lauryl/myristyl alcohol (1:1) + 3 EO (c) 8.0% cetyl/stearyl alcohol (1:1) + 12 EO (d) 45.0% benzine (BP 205°-245° C.)

(e)
22.5% methylene chloride
0.5% perfume.

97.5 Parts by weight of this cleaner composition and 2.5 parts by weight of carbon dioxide were filled into aerosol cans. The cleaner compositions had the same properties as that according to Example 1.

The preceding specific embodiments are illustrative of the practice of the invention. It is to be understood however, that other expedients known to those skilled in the art or disclosed herein, may be employed without departing from the spirit of the invention or the scope of the appended claims.

I claim:

1. A pressurized aerosol spray cleaner, for the spot treatment of textiles before washing, comprising a pressurized container containing from 2 to 3.6 parts by weight of carbon dioxide as propellant and from 96.4 to 98 parts by weight of a spray cleaner composition consisting essentially of, without propellant, (a) from 6% to 16% by weight of ethoxylated $C_6$-$C_{10}$-alcohols selected from the group consisting of alkanols and alkenols, having an average of from 4 to 8 ethylene glycol ether groups, wherein the content of saturated $C_8$-alkanol is at least 50% by weight, (b) from 6% to 10% by weight of ethoxylated $C_{12}$-$C_{18}$-alcohols selected from the group consisting of alkanols and alkenols, having an average of from 2 to 4 ethylene glycol ether groups, wherein the content of $C_{16}$-$C_{18}$-alkanols is not more than 50% by weight, (c) from 6% to 10% by weight of ethoxylated $C_{16}$-$C_{18}$-alcohols selected from the group consisting of alkanols and alkenols, having an average of from 10 to 15 ethylene glycol ether groups, (d) from 40% to 45% by weight of aliphatic hydrocarbons having a boiling range of from 205° to 245° C., and (e) from 10% to 35% by weight of at least one chlorohydrocarbon selected from the group consisting of methylene chloride, ethylene chloride, 1,1,1-trichloroethane and perchloroethane;

with the proviso that components (a), (b) and (c) amount to from 20% to 35% by weight of said composition and components (d) and (e) amount to from 65% to 80% by weight of said composition.

2. The spray cleaner of claim 1 wherein component (a) consists of at least 75% by weight of an ethoxylated octanol with an average of 5 to 7 ethylene glycol ether groups.

3. The spray cleaner of claims 1 or 2 wherein component (b) consists of a mixture of components ($b_1$) and ($b_2$) in a weight ratio of 1:4 to 4:1 wherein component ($b_1$) consists of ethoxylated $C_{12}$-$C_{14}$-alkanols with an average of 2 to 4 ethylene glycol ether groups and component ($b_2$) consists of ethoxylated $C_{16}$-$C_{18}$-alcohols selected from group consisting of alkanols and alkenols with an average of 2 to 3 ethylene glycol ether groups wherein the content of ethoxylated $C_{16}$-$C_{18}$-alkanols does not exceed 65% by weight of component ($b_2$).

4. The spray cleaner of claims 1 or 2 wherein component (c) consists of ethoxylated $C_{16}$-$C_{18}$-alcohols with an average of 11 to 13 ethylene glycol ether groups, 50% to 100% of which are ethoxylated alkanols and 0 to 50% of which are ethoxylated alkenols.

5. The spray cleaner of claims 1 or 2 wherein component (e) is methylene chloride and is present in an amount of 20% to 32% by weight.

6. The spray cleaner of claim 1 having a further content of from 0.1% to 1% by weight of at least one perfume oil.

7. A method of spot treatment of spot-soiled textiles consisting essentially of spraying said spots of soil with an effective amount of the spray cleaner of claim 1, washing said spot-soiled textiles in water with a conventional detergent composition, rinsing said washed textiles, and recovering washed textiles free of spots of soil.

* * * * *